United States Patent [19]

Meyer et al.

[11] 3,947,994

[45] Apr. 6, 1976

[54] FIGURE TOY WITH MEANS FOR EXECUTING ARM THRUSTING MOVEMENT

[75] Inventors: Burton C. Meyer, Downers Grove; Palmer J. Schoenfield, Evanston, both of Ill.

[73] Assignee: Marvin Glass & Associates, Chicago, Ill.

[22] Filed: Nov. 15, 1973

[21] Appl. No.: 416,109

[52] U.S. Cl. ..... 46/148; 46/173

[51] Int. Cl.[2] ..... A63H 13/06

[58] Field of Search ..... 46/148, 128, 118, 119, 46/120, 173, 142, 143

[56] References Cited

UNITED STATES PATENTS

| | | | |
|---|---|---|---|
| 1,812,930 | 7/1931 | Chester | 46/143 |
| 2,954,639 | 10/1960 | Walss | 46/120 |
| 3,235,259 | 2/1966 | Glass et al. | 46/118 |
| 3,376,665 | 4/1968 | Heller | 46/119 X |

FOREIGN PATENTS OR APPLICATIONS

| | | | |
|---|---|---|---|
| 68,163 | 4/1893 | Germany | 46/119 |

*Primary Examiner*—F. Barry Shay
*Attorney, Agent, or Firm*—Coffee & Sweeney

[57] ABSTRACT

An action figure toy in the form of a doll which includes a torso having an arm joint in the shoulder area with a movable arm connected thereto. The arm is connected to a rotatable shaft extending from the torso and has hollow upper arm and lower arm portions swingably joined at an elbow joint. A rod operably connects the shaft and lower arm portion. The upper arm portion is secured to the shaft at the arm joint for rotation therewith. When the shaft is rotated both arm portions will move with respect to the torso as well as with respect to each other in a predetermined sequence simulating a thrusting movement. The figure includes a hip joint between the torso and each of two legs movably mounted thereto. The hip joint includes a hollow housing on which the torso is rotatably mounted and a plurality of spaced apart recesses are formed within the housing. Two leg mounting members are mounted within the housing for movement about a first horizontal axis. Each includes an interior portion within the housing which has a protrusion for engagement within the recesses whereby it can be selectively and independently held after being rotated a given increment about the first axis. Each mounting member also includes an exterior portion having a connection for rotatably mounting the respective leg for movement about a second horizontal axis perpendicular to the first axis.

11 Claims, 12 Drawing Figures

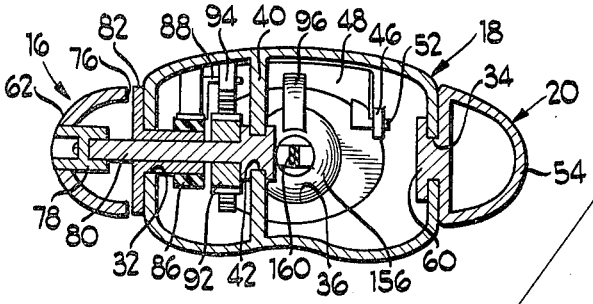
Fig 4
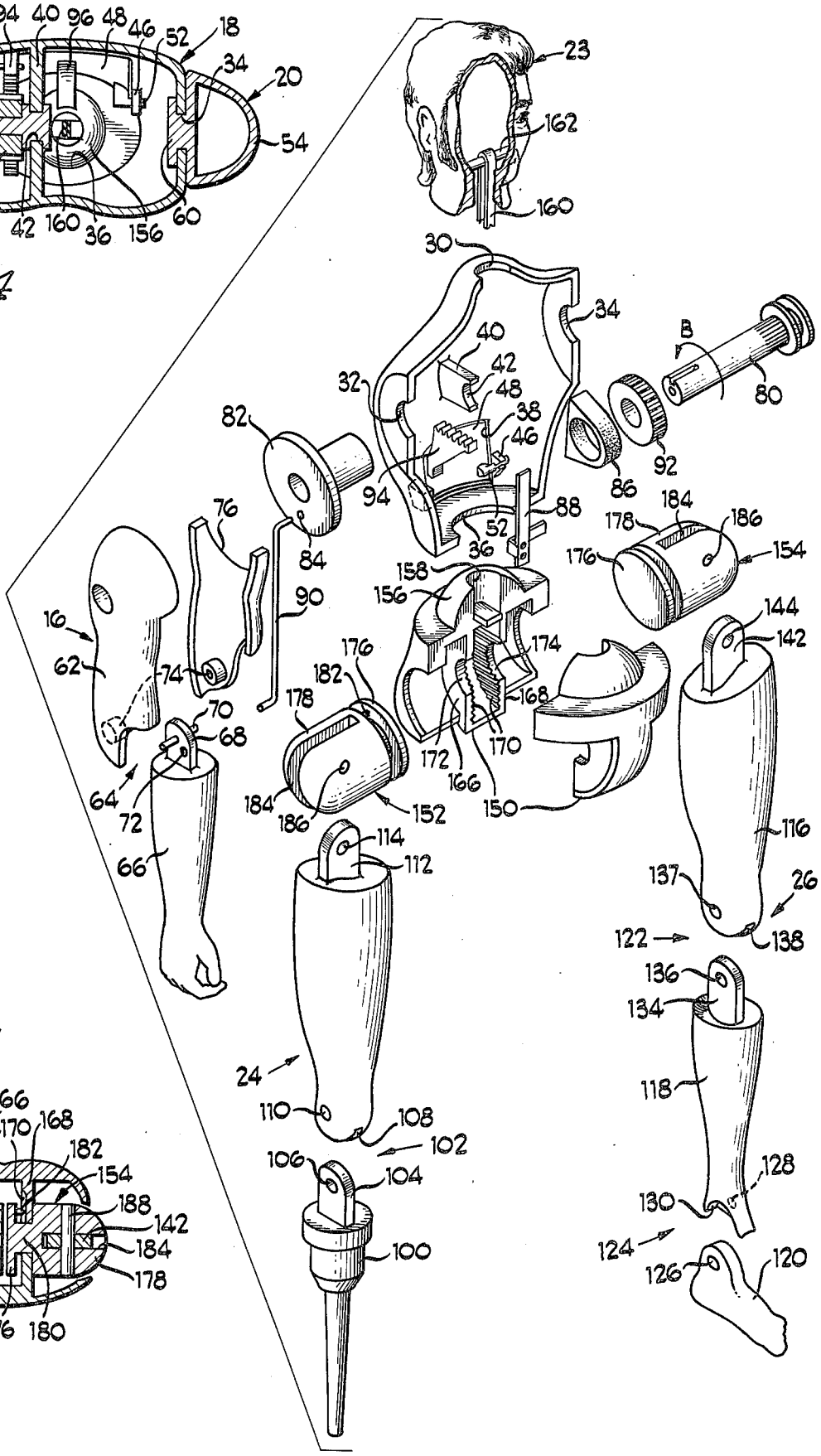
Fig 6
Fig 5
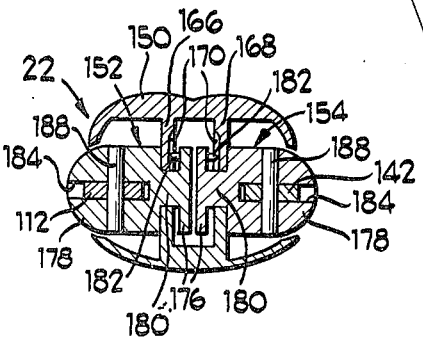

FIGURE TOY WITH MEANS FOR EXECUTING ARM THRUSTING MOVEMENT

BACKGROUND OF THE INVENTION

1. Field of the Invention

The present invention relates to action figure toys and specifically to figure toys with movable arms and legs.

2. Brief Description of the Prior Art

Action figure toys having articulated appendages have enjoyed a great deal of popularity with children throughout the years. Toys of this nature usually take the form of dolls with movable limbs of some sort. Although limb articulation is well known in the prior art, a predetermined or programmed movement of the limbs especially in an arm is not common.

SUMMARY OF THE INVENTION

It is the primary object of the present invention to provide an action figure toy having at least one arm drivingly movable in a predetermined sequence simulating a thrusting movement, and a new and improved hip joint for articulation of legs with respect to a torso.

These and other objects of the present invention are accomplished by one form of the invention currently contemplated which provides for an action figure toy having a torso with means defining an arm joint and a movable arm connected to the torso at the arm joint. The arm joint generally includes arm mounting means mounted for rotation within the torso and having a portion thereof at the arm joint. A hollow upper arm portion has a shoulder end connected to the arm mounting means for rotation therewith and an elbow end. A lower arm portion has an elbow end swingably connected to the elbow end of the upper arm portion and a hand end, and means operably connecting the arm mounting means in the lower arm portion. When the arm mounting means is rotated, both arm portions will move with with a movable arm connected thereto a program sequence simulating a thrusting movement.

The figure toy of the present invention also includes a hip joint between the torso and two legs movably mounted thereto. The improvement in the hip joint generally includes a generally hollow hip housing and two leg mounting members each rotatably mounted within the housing for rotation about a first horizontal axis. The hip housing includes means formed at the top thereof for rotatably mounting the torso thereto for movement about a vertical axis, and recessed positioning means formed within said housing. Each leg mounting member includes an interior portion within the housing having protruding positioning means for engagement within the recessed positioning means whereby each member can be selectively and independently held after being rotated after a given increment about said first horizontal axis, and an exterior portion having means for rotatably mounting a leg for movement about a second horizontal axis perpendicular to the first horizontal axis.

BRIEF DESCRIPTION OF THE DRAWINGS

FIG. 4 is a horizontal section taken generally along line 4—4 of FIG. 2;

FIG. 5 is a horizontal section taken along line 5—5 of FIG. 2;

FIG. 6 is an exploded perspective view of the parts comprising the figure toy of the present invention.

DESCRIPTION OF THE PREFERRED EMBODIMENT

Figure 1:
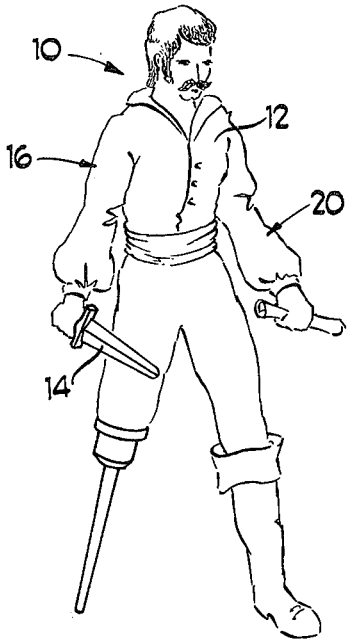
FIG. 1 is a perspective view of the action figure toy of the present invention.

Turning now to FIG. 1 in greater detail, a figure toy, generally designated 10, of the present invention is illustrated. Appropriate clothing 12 adorns the body of the figure toy 10. The figure toy is substantially articulated and has a sword 14 attached to the end of its right arm 16. The right arm 16 is made to move so that it simulates a thrusting movement and therefor effects a forward thrust of the sword 14.

Figure 2:
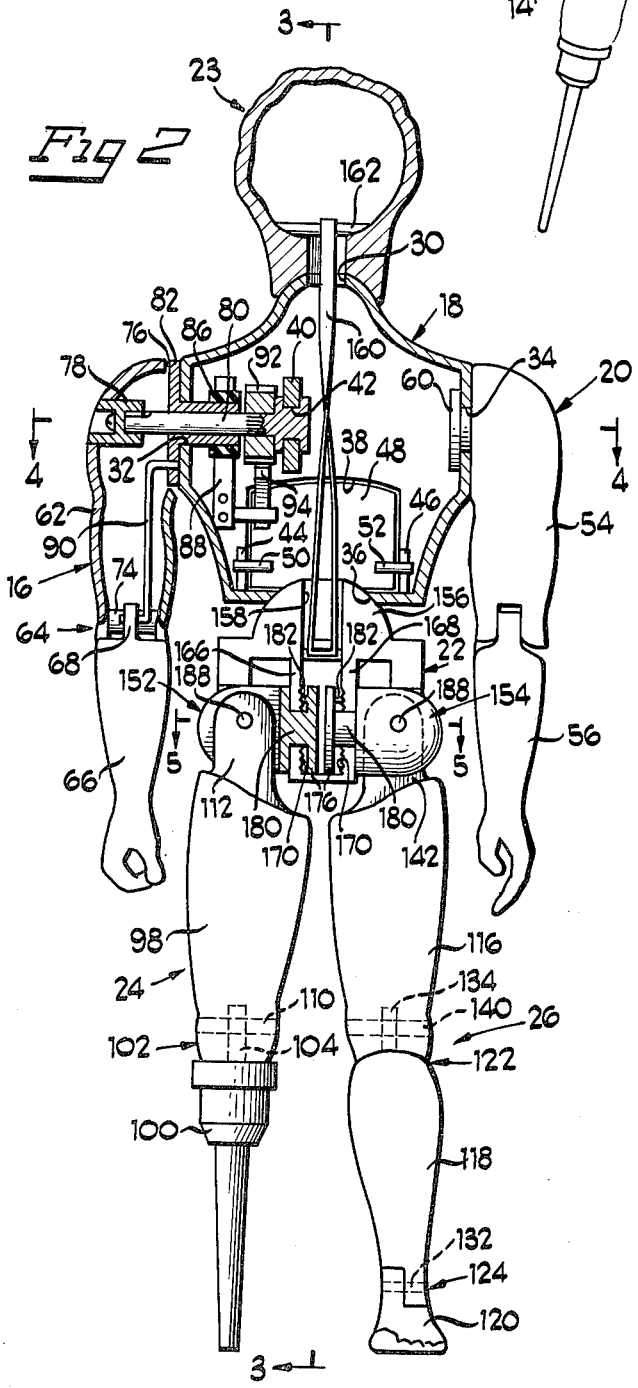
FIG. 2 is a front elevational view, partially in section and on an enlarged scale, of the action figure toy of FIG. 1.
Figure 3:
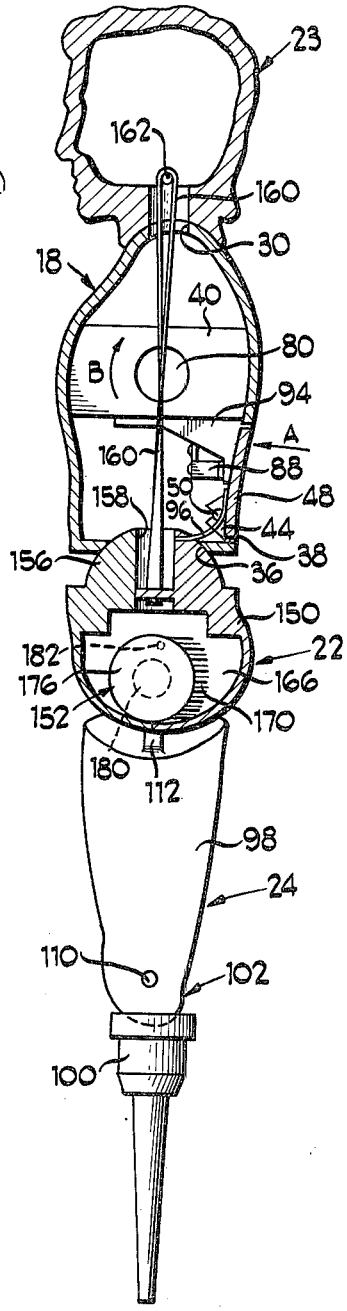
FIG. 3 is a vertical section taken generally along line 3—3 of FIG. 2.

Turning now to FIGS. 2 and 3 in greater detail, the figure toy 10 is seen to generally include a hollow torso, generally designated 18, having the right arm 16 and a left arm 20 secured to the sides thereof, a hip joint, generally designated 22, secured to the bottom of the torso, and a head, generally designated 23, mounted on top of the torso. A right leg, generally designated 24, and a left leg, generally designated 26, are mounted on the bottom of the hip joint 22.

Turning to FIGS. 2–6, the hollow torso 18 is seen to generally include a circular top torso opening 30 underlying the head 23, a circular right side torso opening 32 defining part of a right arm joint, a circular left side torso opening 34 defining part of a left arm joint, a circular bottom torso opening 36 overlying the hip joint 22, and a rectangular back torso opening 38. The interior of the torso 18 has a transverse front-to-rear vertical plate 40 (FIGS. 3 and 4) formed therein. Plate 40 has an opening 42 (FIG. 6) through the center thereof aligned with openings 32 and 34. Ears 44 and 46 (FIG. 2) are formed on either side of the back opening 38 for journalling a shaft therethrough.

As viewed in FIGS. 2, 3, 5 and 6, back opening 38 is covered by a back plate 48 which has two shaft protrusions 50 and 52 formed in either side thereof. Shaft protrusions 50 and 52 are journalled in ears 44 and 46, respectively. When mounted in this fashion to the torso 18, the back plate 48 can be pivoted about the shaft protrusions 50 and 52 in the direction of arrow A (FIG. 3).

Turning to FIG. 2, the left arm 20 in seen to generally include an upper arm portion 54 and a lower arm portion 56 connected together at an elbow joint, generally designated 58. The upper arm portion 54 of the left arm has a connecting portion 60 captured within torso opening 44 forming a left arm joint. The left arm 20 is thus mounted so that it is slectively rotatable in a vertical plane about connecting portion 60 and is bendable at the elbow joint 58 in a selective manner.

Referring to FIGS. 2 and 6, the right arm 16 is seen to generally include a hollow upper arm portion 62 connected at an elbow joint, generally designated 64, to a generally hollow lower arm portion. The elbow joint 64 includes an upstanding tab 68 (see FIG. 6) formed on the top of the lower arm portion 66 with a pin 70 and an aperture 72 formed therein. The pin 70 is journalled within two holes 74 formed in the bottom of the upper arm portion 62. The upper arm portion is shown as comprising two halves, for fabrication purposes. When mounted in this manner, the lower arm portion 66 is capable of pivoting or swinging with respect to the upper arm portion 62 about pin 70.

The upper arm portion 62 of the right arm 16 has a shoulder opening 76 in registry with torso opening 32 (FIGS. 2 and 6). In addition, the upper arm portion 62 has a keyed recess 78 (FIGS. 2 and 4) formed in the interior of the upper arm portion opposite the shoulder opening 76.

Arm 16 is rotatably mounted on an arm joint or arm mounting means which generally includes a horizontal shaft 80 having a disclike member 82 rotatably fit thereon (FIGS. 2, 4 and 6). One end of the shaft 80 is journalled within plate opening 42 while the other end is fixedly secured to the keyed recess 78 so that the upper arm portion 62 will rotate with shaft 80. The disc member 82 is rotatably mounted on the shaft 80 through torso opening 32 and separates the upper arm portion 62 from torso 18. The disc member 82 is an eccentric member having an eccentric aperture 84 spaced from the center thereof.

The disc member 82 has detent means associated therewith to prevent rotation of the disc member relative to the torso 18 except when greater than a normal torque is applied to the disc member and to positively position the disc member 82. Looking at FIGS. 2, 4 and 6, the detent means is seen to generally include a generally D-shaped collar 86 fixedly secured to the disc member 82 for rotation therewith. Secured to the interior of the torso 18 at the back thereof is an upstanding leaf spring 88 which normally abuts the flat side of D-shaped collar 86. The leaf spring is sufficiently flexible so that collar 86 can be rotated thereagainst. However, leaf spring 88 is sufficiently stiff so that D-shaped collar 86 normally will position its flat side thereagainst in the absence of any other forces. Therefore, disc member 82 will not rotate until a sufficiently large torque is applied thereto in order to overcome the effect of the leaf spring 88 pressing against the flat side of the D-shaped collar 86. Once this torque is attained, disc member 82 becomes freely rotatable.

A rod 90 (FIGS. 2 and 6) is disposed in the upper arm portion 62 and has an upper portion thereof received through aperture 84 and a lower portion thereof received through aperture 72 which is off center relative to the elbow pivot 70 as shown in FIG. 6. The rod 90 interconnects the disc member 82 at the right arm joint with the lower arm portion 66 at the elbow joint 64. The interconnection between the lower arm portion 66 and the disc member 82 provides means for the lower arm portion 66 to move with respect to both the upper arm portion 62 and the torso 18 when shaft 80 is rotated.

Shaft 80 is made to rotate by actuation means which generally includes a pinion gear 92 fixedly mounted on shaft 80 within the torso 18. The gear 92 has teeth meshingly engaging the teeth of a gear rack 94 which is fixedly mounted on the interior of back plate 48 (FIGS. 2, 4 and 6). Looking at FIGS. 3 and 6, when back plate 48 is pushed inwardly and pivoted in the direction of arrow A, gear rack 94 causes pinion gear 92 and shaft 80 to rotate in the direction indicated by arrow B.

Figure 7A:
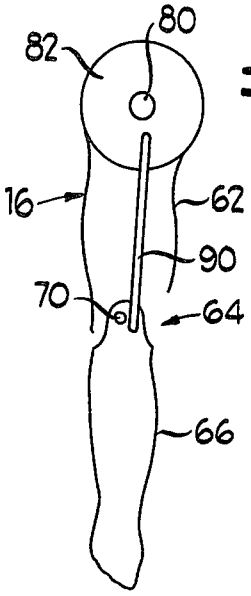
FIGS. 7A–F are vertical sectional schematic views of the arm of the figure toy of the present invention in sequential positions.
Figure 7B:
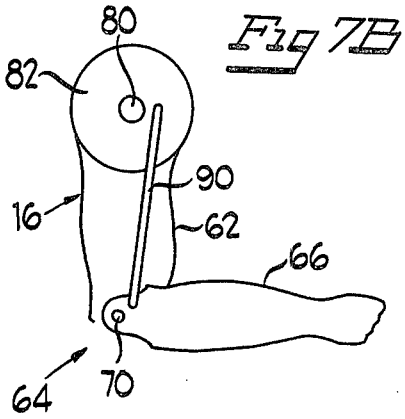

Turning now to FIGs. 7A–F, the positions through which arm moves are shown. In FIG. 7A, arm 16 is in an initial, vertically oriented, downwardly extending position. The lower arm portion 66 is then manually lifted to a horizontal generally perpendicular disposition, the preset position relative to the upper arm portion 62 as shown in FIG. 7B. The lifting of lower arm portion 66 makes rod 90 push against the disc member 82 causing rotation of the disc member. The pressing of leaf spring 88 against the flat side of the D-shaped collar 86 will hold the disc member in that position until further force is applied.

Figure 7C:
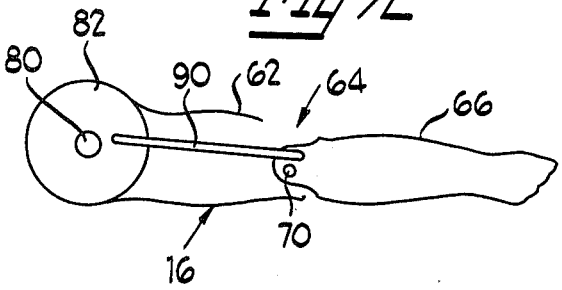

After arm 16 has assumed the preset position shown in FIG. 7B, back plate 48 is pushed inwardly as above described. This causes shaft 80 and upper arm portion 62 to rotate relative to disc member and torso 18. The movement of upper arm portion in this manner causes rod 90 to push lower arm portion 66 so that lower arm portion will rotate relative to the upper arm portion about pin 70 until arm 16 attains a horizontally thrusting position as shown in FIG. 7C.

Figure 7D:
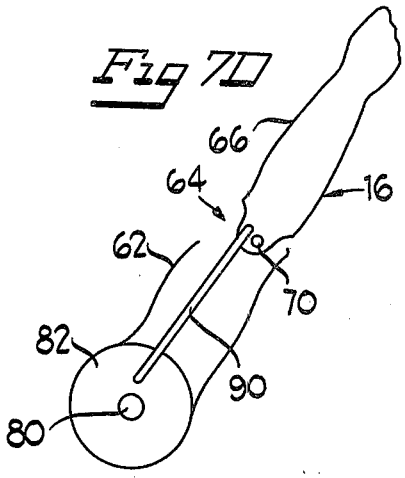
Figure 7E:
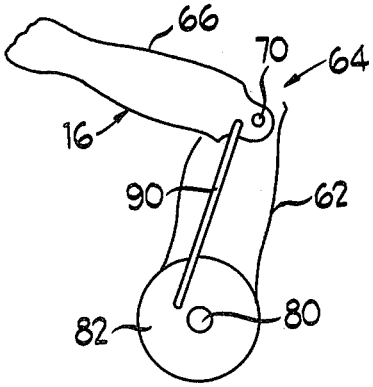

Further pushing on back plate 48 and, thus, further rotation of shaft 80 and upper arm portion 62, causes arm 16 to attain an after thrust position as illustrated in FIG. 7D. The rotation of the upper arm portion 62 causes disc member 82 to rotate resulting in the rotation of the collar 86 relative to leaf spring 88.

Still further pushing of back plate 48 will cause further rotation of the upper portion 62 and disc member 82 until lower arm portion 66 assumes an over center position with respect to pivot pin 70. At this point, the rounded portion of collar 86 abuts the leaf spring 88 so that the disc member becomes freely rotatable. When this occurs, the lower arm portion 66 will rotate at the elbow joint 64 by force of gravity resulting in the position shown in FIG. 7E.

It is to be noted that the positions of FIGS. 7A–F above described are to take place in relatively quick succession giving the appearance of a fluid thrusting movement. With this movement, the figure toy 10 is capable of simulating the thrusting action of a swordsman.

Figure 7F:
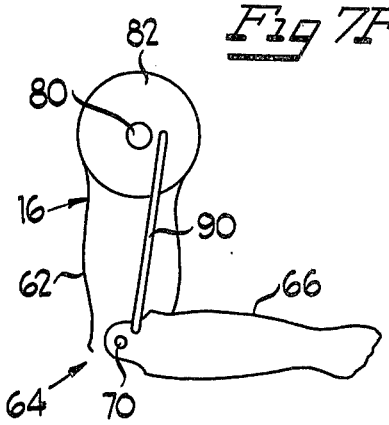

In order to return arm 16 to its preset position, a leaf spring 96 is mounted to the bottom of the interior of torso 18 and bears against the interior of back plate 48. Thus, when manual pressure is released, after pushing on back plate 48, the leaf spring 96 will push plate 48 in a direction opposite that of arrow A (FIG. 3). This will cause arm 16 to move from its final position (FIG. 7E) back to its preset position (FIG. 7F).

The intersection of the D-shaped collar and the leaf spring 88 insure that disc member 82 will return to its preset position after actuation and release of the back plate 48.

Turning now to FIGS. 2, 3 and 6, the right leg 24 is seen to include an upper leg portion 98 and a lower leg portion 100 joined together at a knee joint, generally designated 102. Knee joint 102 has a tab 104 formed on the top of the lower leg portion 100, with an aperture 106 therein, and a receiving slot 108 formed in the bottom of the upper leg portion 100 for pivotally receiving tab 104 by means of a pin 110. The upper leg portion 98 also includes a hip connecting portion in the form of a tab 112 formed at the top thereof with an aperture 114 therein.

The lower leg portion 100 of the figure toy is molded in a configuration of a "peg leg." This gives the figure toy the appearance of a pirate.

The left leg 26, looking at FIG. 6, is seen to generally include an upper leg portion 116, a lower leg portion 118 and a foot 120. The upper leg portion 116 and the lower leg portion 118 are pivotally connected to each other at a knee joint, generally designated 122. The lower leg portion 118 and the foot 120 are pivotally joined to each other at an ankle joint, generally designated 124.

Foot 120 has an aperture 126 formed therein which is alignable with aperture 128 formed near the bottom of the lower leg portion 118. Aperture 128 is formed in a cutout ankle receiving portion 130. The ankle joint 124 is completed by mounting a pin 132 through apertures 126 and 128 when they are aligned. In this fashion foot 120 is swingably mounted to lower leg portion 118.

The knee joint 122 is seen to generally include a tab 134 formed on the top of the lower leg portion 116, with an aperture 136 formed therein, and a slotted receiving portion 138 formed in the bottom of the upper leg portion 116 to receive the tab 134. The slotted portion 138 has apertures 137 which are alignable with aperature 136 so that a pin 140 can be inserted therethrough to effect a swinging connection between the upper leg portion 116 and the lower leg portion 118. The upper leg portion 116 also includes a hip connecting portion in the form of a tab 142 having an aperture 144 formed therein.

Looking at FIGS. 2, 3, 5 and 6, the hip joint 22 is seen in generally include a generally hollow housing 150 and two leg mounting members, generally designated 152 and 154. The hip joint not only mounts torso 118 for limited universal and rotational movement thereon but also mounts legs 24 and 26 for rotation in two vertical perpendicular planes.

The housing 150 has a rounded raised torso mounting portion 156 formed on the top thereof which is partially received through bottom torso opening 36 (FIGS. 2 and 3) forming a type of ball and socket connection providing universal movement therebetween. The torso mounting portion has an opening 158 formed therein communicating with the interior of the housing 150. A rubber band 160 is stretched between a pin 162 mounted in head 23 and a transverse member formed in the housing 150 below opening 158. The rubber band 160 is received through the head opening 30 and torso 18 through openings 36 and 158 into the housing 150. The tension of the rubber band 160 serves to keep the head 23 on torso 18 in various selected universal orientations. In this manner, head 23 can be turned as desired. In addition, the torso 18 is likewise mounted on the torso mounting portion 156. Thus, torso 18 can be turned or twisted about a somewhat universal axis with respect to the hip joint 22, in any attitude desired.

The housing 150 also includes two spaced apart vertical parallel interior walls 166 and 168 having facing surfaces with a plurality of parallel spaced apart linear horizontal recesses 170 formed thereon. Each wall 166 and 168 has a circular opening 172 and 174, respectively, formed therein. The housing 150 is shown to include two halves, for fabrication and assembly purposes.

Each leg mounting member 152 and 154 is seen to include a disc-like interior portion 176 and an exterior dome-shaped portion 178 interconnected by a reduced shaft portion 180. The shaft portions 180 of leg mounting members 152 and 154 are journalled in openings 172 and 174 respectively thereby capturing the interior portion 176 within walls 166 and 168. Thus, leg mounting members 152 and 154 are mounted for rotation about a side-to-side horizontal axis with respect to the housing 150.

The interior portion 178 has a protrusion extending toward the recesses 170 for engagement therewith (FIGS. 2, 5 and 6). When a leg mounting member 152 or 154 is rotated, the interengagement of the protrusion 182 with one of the recesses 170 will position that particular leg mounting member at a certain rotational attitude.

The exterior portion 178 of each leg mounting member 152 and 154 has a slot 184 formed therein with holes 186 therethrough (FIGS. 5 and 6). Tabs 112 and 142 of legs 24 and 26, respectively, are received within the slots 184 so that the holes 186 align with the tab apertures 114 and 144. When the apertures are thus aligned, a pin 188 is received therethrough for rotatingly mounting each leg 24 and 26 at the hip joint 22 for rotation about a front-to-back horizontal axis (FIG. 5).

As can be seen, the hip joint 22 as above described permits the legs to have virtually an infinite amount of articulation in two planes. That is, the legs can be moved backward and forward relative to the torso 18 by rotation of leg mounting members 152 and 154 relative to the housing 150, as well as being capable of moving sideways relative to the hip joint 22 by rotating legs 24 and 26 relative to the leg mounting member.

The figure toy of the present invention can be made of any suitable material, such as molded plastic. Because of the molding process and ease of construction it is understood that many of the parts described herein may be manufactured in more than one piece and then subsequently secured together.

We claim:

1. An action figure toy including a torso having means defining an arm joint and a movable arm connected thereto, comprising:

a shaft mounted for rotation with respect to the torso having one end thereof connected to the movable arm;

an eccentric member rotatably mounted on the shaft at the arm joint;

a generally hollow upper arm portion having a shoulder and an elbow end, said shoulder end being secured to said shaft at the arm joint for rotation therewith;

a lower arm portion having an elbow end and a hand end, said lower arm portion being swingably mounted to said upper arm portion about an elbow pivot at the respective elbow ends;

a rod connected at one end to said eccentric member off center relative to the shaft and pivotally connected at the other end to the lower arm portion near the elbow end thereof at a point spaced from and off center relative to said elbow pivot, said arm being movable from a preset position wherein the upper arm is generally vertically oriented alongside the torso and the lower arm portion is generally horizontally positioned at right angles with the upper arm to a thrusting position wherein the upper arm portion and lower arm portion are generally horizontally aligned extending generally at a right angle with the torso after the shaft has been rotated to a predetermined arc and then from the thrusting position to an after-thrust position after further rotation of the shaft, whereby said arm moves in a programmed sequence simulating a thrusting movement in response to rotation of the shaft;

actuation means for selectively rotating said shaft, said actuation means including a pinion gear secured to said shaft for rotation therewith, a gear rack meshingly engaging said pinion gear and mounted for movement within the torso, a plate forming a movable part of the torso secured to said gear rack whereby the shaft is rotated in response to pushing the plate, and return means for positively pushing the movable plate back to its original position after actuation causing the arm to move from its after-thrust position to its preset position; and detent means mounted on the eccentric member for positioning said eccentric member so that it will be in the preset position after actuation.

2. The toy of claim 1 wherein said return means includes a leaf spring mounted within the torso and biased against said plate.

3. The toy of claim 1 wherein said detent means includes a D-shaped collar fixedly mounted on said eccentric member for rotation therewith and an upstanding leaf spring mounted on the torso adjacent said D-shaped collar for abutting the flat side of the D-shaped collar.

4. The toy of claim 3 wherein said lower arm portion is manually movable between an initial position wherein the upper and lower arm portions are generally vertically aligned alongside the torso and the preset position.

5. The toy of claim 4 wherein the flat side of said D-shaped collar abuts the leaf spring when said lower and upper arm portions are in the initial position.

6. An improved action figure toy including a torso having an arm mounting means defining an arm joint and a movable arm connected to said arm joint, the improvement comprising:

arm mounting means including a shaft mounted for rotation with respect to said torso and having a portion thereof at the arm joint;

a generally hollow upper arm portion having a shoulder end and an elbow end, said shoulder end being secured to said shaft for rotation therewith;

a lower arm portion having an elbow end and a hand end, said lower arm portion being swingably mounted to said upper arm portion about an elbow pivot at their respective elbow ends; and connecting means including an eccentric member, mounted on the shaft for rotation with respect thereto and a rod connected at one end to said eccentric member with the opposite end being connected to the lower arm portion near the elbow end thereof at a point spaced from said elbow pivot so that the upper arm portion will rotate with respect to the torso and the lower arm portion will move with respect to the torso in a programmed sequence simulating a thrusting movement in response to rotation of the shaft, and detent means associated with the lower arm portion for permitting manual movement of the lower arm portion relative to the upper arm portion and torso, and for maintaining the lower arm portion in a preset position.

7. The toy of claim 6 wherein said member is connected to said detent means to maintain the lower arm portion in its preset position with respect to the torso.

8. The toy of claim 6 wherein said detent means includes a D-shaped collar fixably mounted on said member for rotation therewith and an upstanding leaf spring fixedly mounted in said torso adjacent said D-shaped collar for abutting the flat side of the D-shaped collar when the lower arm portion is in its initial generally vertical position alongside the torso.

9. The toy of claim 6 including actuation means associated with said shaft for selectively rotating said mounting means.

10. The toy of claim 9 wherein said actuation means includes a pinion gear secured to said shaft for rotation therewith, a gear rack meshingly engaging said pinion gear and mounted for movement with respect to the torso, said gear rack having a portion thereof forming a movable part of the torso, whereby the shaft is rotated and the arm is moved from its preset position to its thrusting position in response to pushing of the movable part of the torso.

11. The toy of claim 10 wherein said actuation means includes return means to positively move the movable part of the torso back to its original position after actuation, causing the arm to move from its thrusting position to its preset position.

* * * * *